US009265393B2

(12) United States Patent
Frank et al.

(10) Patent No.: US 9,265,393 B2
(45) Date of Patent: Feb. 23, 2016

(54) VACUUM CLEANER

(71) Applicant: Alfred Kärcher GmbH & Co. KG, Winnenden (DE)

(72) Inventors: Juergen Frank, Kirchberg (DE); Maic Hensel, Backnang (DE)

(73) Assignee: Alfred Kärcher GmbH & Co. KG, Winnenden (DE)

( * ) Notice: Subject to any disclaimer, the term of this patent is extended or adjusted under 35 U.S.C. 154(b) by 0 days.

(21) Appl. No.: 14/660,193

(22) Filed: Mar. 17, 2015

(65) Prior Publication Data

US 2015/0182083 A1 Jul. 2, 2015

Related U.S. Application Data

(63) Continuation of application No. PCT/EP2012/068360, filed on Sep. 18, 2012.

(51) Int. Cl.

| | |
|---|---|
| ***A47L 5/00*** | (2006.01) |
| ***A47L 5/36*** | (2006.01) |
| ***A47L 9/20*** | (2006.01) |
| ***A47L 9/28*** | (2006.01) |
| ***A47L 7/00*** | (2006.01) |
| ***A47L 9/10*** | (2006.01) |

(52) U.S. Cl.

CPC ..... *A47L 5/365* (2013.01); *A47L 7/0004* (2013.01); *A47L 9/10* (2013.01); *A47L 9/20* (2013.01); *A47L 9/2878* (2013.01); *A47L 9/2884* (2013.01)

(58) Field of Classification Search

CPC ..... A47L 5/365; A47L 7/0004; A47L 9/10; A47L 9/20; A47L 9/2878; A47L 9/2884

USPC ..... 15/327.2, 327.6, DIG. 1

IPC ..... A47L 5/00

See application file for complete search history.

(56) References Cited

U.S. PATENT DOCUMENTS

| | | | |
|---|---|---|---|
| 5,704,956 | A | 1/1998 | Loveless et al. |
| 7,120,965 | B2 | 10/2006 | Hisano et al. |
| 7,472,456 | B2 | 1/2009 | Moore et al. |
| 8,590,103 | B2 | 11/2013 | Wolfe, Jr. |

(Continued)

FOREIGN PATENT DOCUMENTS

| | | |
|---|---|---|
| DE | 4421458 | 12/1995 |
| DE | 20 2005 014 736 | 3/2006 |

(Continued)

*Primary Examiner* — David Redding

(74) *Attorney, Agent, or Firm* — Womble Carlyle Sandridge & Rice, LLP

(57) ABSTRACT

A vacuum cleaner is provided, including a dirt collection container, a suction unit for acting on the dirt collection container with negative pressure via a suction chamber, at least one filter element arranged between the dirt collection container and the suction chamber in the flow direction of the air sucked in by the suction unit, a filter cover covering the filter element on the clean space side, at least one rechargeable battery for providing electrical energy for the suction unit, and at least one battery receptacle. The vacuum cleaner can further include a battery lid, which includes the at least one battery receptacle, and which is arranged above the filter cover, the battery lid being transferable from a closed position in which it covers the filter cover to an open position in which a user has access on the clean space side to the filter cover, and vice versa.

19 Claims, 4 Drawing Sheets

(56) References Cited

U.S. PATENT DOCUMENTS

| | | | |
|---|---|---|---|
| 8,601,640 | B2 | 12/2013 | Bertram et al. |
| 2008/0062618 | A1 | 3/2008 | Frank et al. |
| 2010/0275395 | A1 | 11/2010 | Poch et al. |
| 2013/0239360 | A1 | 9/2013 | Hensel et al. |

FOREIGN PATENT DOCUMENTS

| | | |
|---|---|---|
| EP | 2 002 773 | 12/2008 |
| JP | H07-327870 | 12/1995 |
| JP | 2001 321298 | 11/2001 |
| JP | 2003-038403 | 2/2003 |
| WO | WO 2006/084561 | 8/2006 |
| WO | WO 2008/070962 | 6/2008 |

VACUUM CLEANER

CROSS-REFERENCE TO RELATED APPLICATIONS

This application is a continuation patent application of international application number PCT/EP2012/068360, filed on Sep. 18, 2012, which is incorporated herein by reference in its entirety and for all purposes.

FIELD OF THE INVENTION

The present invention relates to a vacuum cleaner, comprising a dirt collection container for sucked-in vacuumed material, a suction unit for acting on the dirt collection container with negative pressure via a suction chamber, at least one filter element arranged between the dirt collection container and the suction chamber in the flow direction of the air sucked in by the suction unit, and a filter cover covering the filter element on the clean space side, at least one rechargeable battery for providing electrical energy for the suction unit, and at least one battery receptacle for holding the at least one battery on the vacuum cleaner.

BACKGROUND OF THE INVENTION

A vacuum cleaner of the aforementioned kind is described in WO 2012/062579 A1. The vacuum cleaner comprises a housing with a housing cover which is pivotable into an open position. In the open position, a battery compartment of the vacuum cleaner is released, and the user has access to two rechargeable batteries which are each accommodated in a battery receptacle. The battery receptacles are arranged on the top side of the filter cover. To gain access to the filter cover, for example, for maintenance of a filter cleaning device arranged on the filter cover, the user must first remove the batteries from the battery receptacles. When the user wants to access the filter element for maintenance purposes, previous removal of the sometimes heavy batteries from the battery receptacles is also necessary in order that the filter cover is more easily transferable from a position covering the filter element to a position releasing the filter element. The provision of the battery receptacles on the top side of the filter cover also requires a certain constructional height especially since there remains below the housing cover a spacing from the batteries for improved heat dissipation and better cooling of the batteries.

The vacuum cleaner described in WO 2012/062579 A1 performs well in practice. Provision of a vacuum cleaner with a more compact design and simplified access to the filter cover is, however, desirable.

An object underlying the present invention is to provide a generic vacuum cleaner which has a more compact design and in which access to the filter cover is facilitated.

SUMMARY OF THE INVENTION

In an aspect of the invention, a vacuum cleaner comprises a dirt collection container for sucked-in vacuumed material, a suction unit for acting on the dirt collection container with negative pressure via a suction chamber, at least one filter element arranged between the dirt collection container and the suction chamber in the flow direction of the air sucked in by the suction unit, and a filter cover covering the filter element on the clean space side, at least one rechargeable battery for providing electrical energy for the suction unit, and at least one battery receptacle for holding the at least one battery on the vacuum cleaner. The vacuum cleaner comprises a battery lid, which includes the at least one battery receptacle, and which, in relation to a positioning of the vacuum cleaner on a floor surface in an operating position, is arranged above the filter cover, the battery lid being transferable from a closed position in which it covers the filter cover to an open position in which a user has access on the clean space side to the filter cover, and vice versa.

BRIEF DESCRIPTION OF THE DRAWING FIGURES

The foregoing summary and the following description may be better understood in conjunction with the drawing figures, of which:

DETAILED DESCRIPTION OF PREFERRED EMBODIMENTS OF THE INVENTION

Figure 1:
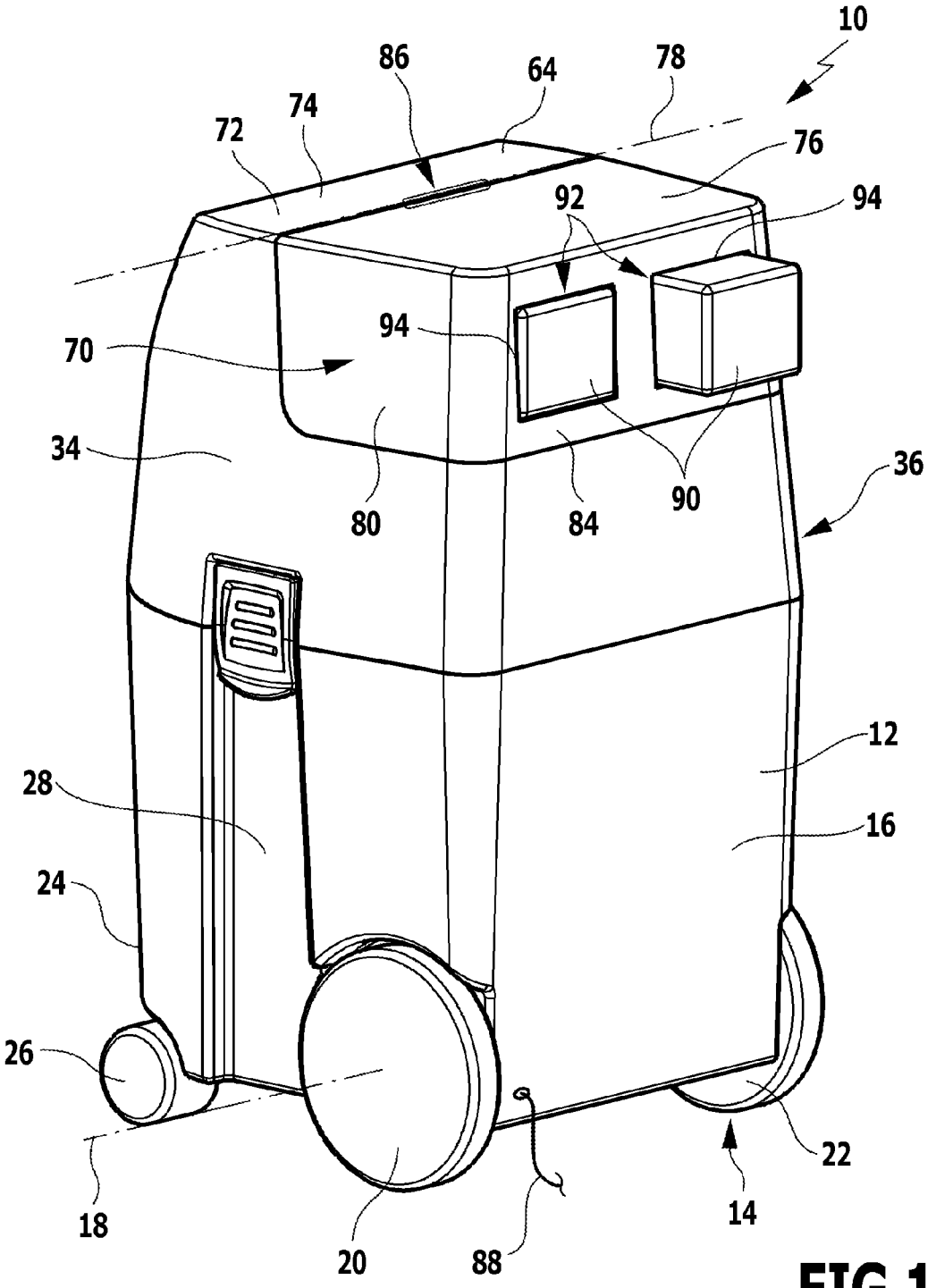
FIG. 1 shows a perspective representation of a first preferred embodiment of a vacuum cleaner in accordance with the invention, comprising a battery lid in a closed position.

Although the invention is illustrated and described herein with reference to specific embodiments, the invention is not intended to be limited to the details shown. Rather, various modifications may be made in the details within the scope and range of equivalents of the claims and without departing from the invention.

The present invention relates to a vacuum cleaner, comprising a dirt collection container for sucked-in vacuumed material, a suction unit for acting on the dirt collection container with negative pressure via a suction chamber, at least one filter element arranged between the dirt collection container and the suction chamber in the flow direction of the air sucked in by the suction unit, and a filter cover covering the filter element on the clean space side, at least one rechargeable battery for providing electrical energy for the suction unit, and at least one battery receptacle for holding the at least one battery on the vacuum cleaner. The vacuum cleaner comprises a battery lid, which includes the at least one battery receptacle, and which, in relation to a positioning of the vacuum cleaner on a floor surface in an operating position, is arranged above the filter cover, the battery lid being transferable from a closed position in which it covers the filter cover to an open position in which a user has access on the clean space side to the filter cover, and vice versa.

In the present case, position and orientation indications such as, for example, “at the top”, “at the bottom”, “horizontally” or the like relate to a positioning of the vacuum cleaner on a floor surface to be regarded as horizontal in an operating position. “At the front” and “at the rear” relate to a longitudinal or main direction of motion of the vacuum cleaner, for example, when it is pushed by means of a push bar over the floor surface.

In the vacuum cleaner in accordance with the invention, the at least one battery receptacle is comprised by a battery lid. In the present case, this may, in particular, be understood as meaning that it is arranged in the battery lid, in particular, integrated in the battery lid. In the closed position, the battery lid including the at least one battery accommodated therein is arranged above the filter cover and covers the filter cover. In an open position, the user has access on the clean space side to the filter cover so that the filter cover is easy to access for maintenance of, for example, the filter element. In particular, it is not necessary, as in the vacuum cleaner described in WO 2012/062579 A1, for the user to previously remove the at least one battery from the at least one battery receptacle so as to be able to access the filter cover. Furthermore, practice shows that a compact design can be achieved with the vacuum cleaner in accordance with the invention. The battery lid arranged above the filter cover allows battery receptacles which require space, as in the vacuum cleaner described in WO 2012/062579 A1, on the filter cover to be dispensed with.

In order to achieve a compact design of the vacuum cleaner, it is, in particular, advantageous if the battery lid and the filter cover are arranged alongside at least one accommodating chamber in which the suction unit and/or an electronic control unit of the vacuum cleaner are arranged. For example, the filter cover and the battery lid are arranged in the area of a rear side of the vacuum cleaner, and an electronic control unit and a suction unit in the area of a front side of the vacuum cleaner. Here the control unit can, in particular, be positioned alongside the battery lid, and the suction unit alongside the filter cover.

The at least one battery is preferably removable from the at least one battery receptacle when the battery lid is in the closed position, in order to facilitate handling of the vacuum cleaner. In a corresponding manner, the at least one battery may be insertable into the at least one battery receptacle when the battery lid is in the closed position.

It is advantageous if the at least one battery receptacle comprises an opening arranged at a rear side of the vacuum cleaner, in relation to the longitudinal direction thereof, for passing the at least one battery therethrough. Practice shows that this facilitates handling of the vacuum cleaner. Maintenance operations on vacuum cleaners, such as, in the present case, exchange of the at least one battery through the opening and preferably access to the filter cover and the least one filter element, are usually performed from a rear side.

During cleaning operations, on the other hand, the vacuum cleaner is usually operated from the front side at which at least one electric operating element is preferably arranged and a suction connection for connecting a suction hose.

It is advantageous if the at least one battery receptacle forms an accommodating shaft for the at least one battery, in particular, if the accommodating shaft is aligned horizontally. In the accommodating shaft, the battery can be reliably held on the battery lid. In addition, the insertion of the battery into and the removal of the battery from the battery receptacle can be carried out in a user-friendly manner. For example, the advantageously horizontal alignment of the shaft allows the battery to be supported on a bottom of the receptacle, so that the holding of the battery in the battery receptacle is facilitated and, therefore, the construction of the vacuum cleaner is kept simple. Moreover, a possible accumulation of dirt in the battery receptacle, unlike in a battery receptacle which is open in the upward direction, is made difficult by the horizontally aligned accommodating shaft.

In a designated position in the at least one battery receptacle, a section of the at least one battery preferably protrudes therefrom so that it can be gripped particularly easily by a user for removal from the battery receptacle.

In a further advantageous embodiment of the vacuum cleaner in accordance with the invention, it is advantageous if the at least one battery receptacle comprises a protective cover which, in a protective position, sealingly closes the at least one battery receptacle, and is transferable to a release position, and vice versa, in which release position the at least one battery is removable from or insertable into the at least one battery receptacle. The at least one battery receptacle may comprise the protective cover for improved protection of the battery receptacle and a battery, if arranged therein, against dirt and/or liquid, in particular, spray water. It may be provided that the protective cover adopts the protective position independently of whether a battery is arranged in the battery receptacle or not. It is also conceivable for the protective cover to adopt the protective position in the absence of a battery and to adopt the release position when a battery is arranged in the battery receptacle. In particular, this may be the case when, as in the last-described advantageous embodiment of the vacuum cleaner, in the designated position, a section of the battery protrudes from the battery receptacle. The protective cover can be held in a clamping and/or latching manner in the protective position and/or in the release position. It may be movably mounted on the battery lid, for example, pivotably or displaceably mounted. For example, the protective cover is a flap which pivots into the release position when the battery is inserted into the battery receptacle.

The battery lid preferably forms a housing cover of a housing of the vacuum cleaner in order to simplify the constructional design of the vacuum cleaner. For example, the battery lid forms a section of the housing at the top side and in the area of a rear side and at rearward side sections of the housing.

The battery lid can be movably mounted on the vacuum cleaner for transfer from the closed position to the open position and vice versa.

In particular, it is advantageous if the battery lid is pivotably mounted on the vacuum cleaner for transfer from the closed position to the open position and vice versa. The battery lid is held, for example, by means of a hinge defining a pivot axis on the housing of the rest of the vacuum cleaner. The pivot axis extends, for example, horizontally and in the transverse direction of the vacuum cleaner. It is conceivable for the battery lid to be pivotable from the rear side of the vacuum cleaner forwards and upwards for transfer from the closed position to the open position.

It is advantageous if the vacuum cleaner comprises a first arresting device for arresting the battery lid in the open position as this facilitates handling of the vacuum cleaner. In the open position, the battery lid is arrested, and it is not necessary for a user to hold the battery lid when he wants to access the filter cover.

The arresting device is preferably configured as latching device and/or as clamping device.

The filter cover is advantageously transferable from a covering position in which the at least one filter element is covered to a removal position in which the at least one filter element is removable from and insertable into the vacuum cleaner on the clean space side, and vice versa. Access to the at least one filter element on the clean space side in the removal position of the filter cover facilitates maintenance of the vacuum cleaner.

The filter cover may be movably mounted on the rest of the vacuum cleaner for transfer from the covering position to the removal position and vice versa.

In particular, it is advantageous if the filter cover is pivotably mounted on the vacuum cleaner for transfer from the covering position to the removal position and vice versa. For example, provision is made to pivot the filter cover upwards and from a rear side of the vacuum cleaner in the direction of a front side. A hinge can define a pivot axis, which is preferably parallel to that pivot axis about which the battery lid is pivotable.

The vacuum cleaner preferably comprises a second arresting device for arresting the filter cover in the removal position. This makes it easier for a user to service the vacuum cleaner. In the removal position, the filter cover is arrested so that it is easier for the user to access the at least one filter element without having to hold the filter cover.

The arresting device is preferably configured as latching device and/or as clamping device.

Provision of the first arresting device is not a requirement for provision of the second arresting device and vice versa. The designations "first" and "second" in the present case are to facilitate understanding.

It proves advantageous if the vacuum cleaner comprises a filter cleaning device for cleaning the at least one filter element. Cleaning the at least one filter element makes it possible to keep the suction power of the vacuum cleaner substantially at a constant level. The replacement interval for the at least one filter element can, therefore, be extended. The filter cleaning device may be manually actuatable. It may also be provided that the filter cleaning device is actuated automatically, for example, in a time-controlled manner, by an electronic control unit of the vacuum cleaner. Control of the filter cleaning device depending on the requirements and on the kind and amount of sucked-in vacuumed material is also conceivable.

It is advantageous if the filter cleaning device is mounted on the filter cover, and it is particularly preferred for it to be at least partially arranged in the suction chamber. A constructionally simple configuration and compact design of the vacuum cleaner can thereby be achieved. Following transfer of the battery lid to the open position, the filter cleaning device can be accessible on the clean space side from above. Additionally or alternatively, a bottom section of the filter cleaning device can be accessible following transfer of the filter cover to the removal position. In both cases, the filter cleaning device in the vacuum cleaner in accordance with invention can be serviced in a user-friendly manner.

Preferably, the filter cover in the covering position of the filter cover or a filter cleaning device mounted on the filter cover in the covering position of the filter cover sealingly closes the suction chamber. This makes a constructionally simple configuration of the vacuum cleaner possible, in which separate sealing of the suction chamber may be dispensed with.

The vacuum cleaner may, in particular, be a bagless vacuum cleaner, for example, a so-called wet-dry vacuum cleaner, which is suitable for sucking in both solid particles and liquid.

The dirt collection container, especially in the last-mentioned advantageous embodiment of the vacuum cleaner may, in particular, be of bucket-shaped or tub-shaped configuration and is preferably accommodated in a bottom part of the vacuum cleaner. The vacuum cleaner may comprise a top part, accommodating the at least one filter element, the filter cover, the battery lid, the suction unit and an electronic control unit, in particular, a so-called "suction head", which can be detachably mounted on the bottom part.

The vacuum cleaner is preferably a hybrid vacuum cleaner having a connecting cable which is connectable to an energy supply network for providing electrical energy to the vacuum cleaner. This allows more versatile use of the vacuum cleaner, which may be operated on the energy supply network and also on battery power. It may be provided that the at least one battery is chargeable in the at least one battery receptacle when the connecting cable is connected to the energy supply network.

Figure 2:
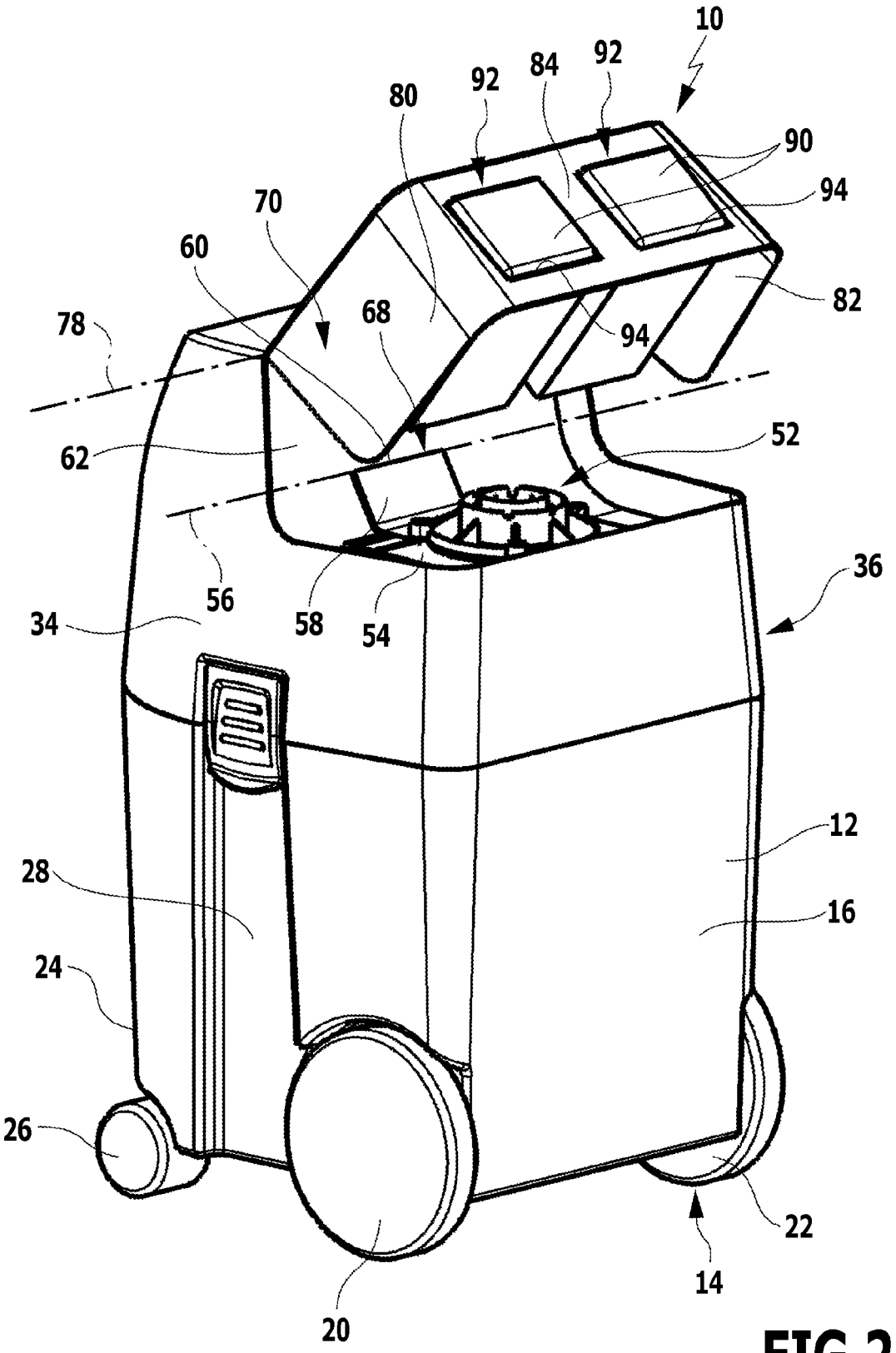
FIG. 2 shows the vacuum cleaner from FIG. 1, with the battery lid in an open position.
Figure 3:
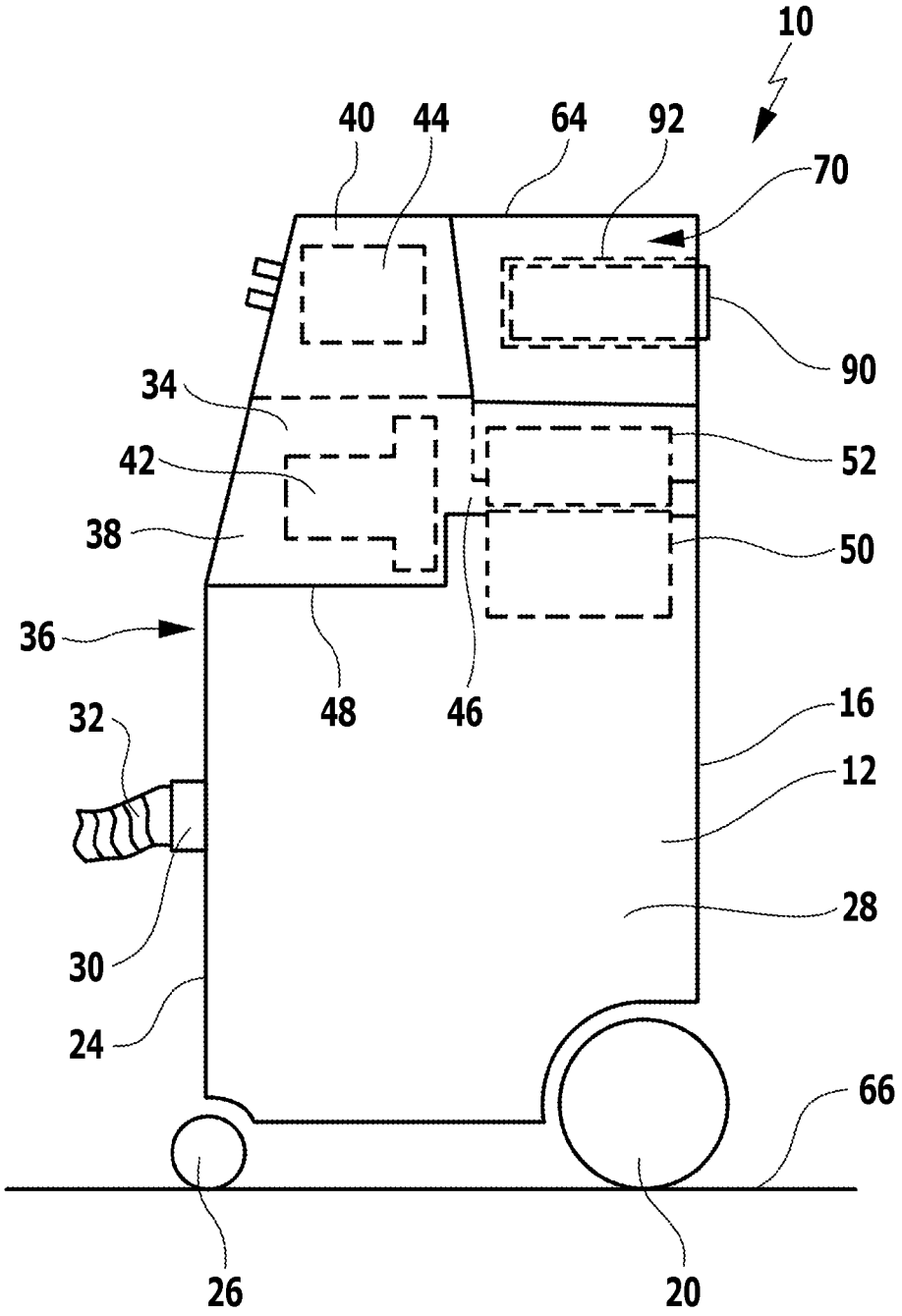
FIG. 3 shows a schematic side view of the vacuum cleaner from FIG. 1.

FIGS. 1 to 3 show a first preferred embodiment of a vacuum cleaner in accordance with the invention, which is denoted in its entirety by reference numeral 10. The vacuum cleaner 10 is a so-called wet-dry vacuum cleaner which is suited for sucking in both solids and liquids.

The vacuum cleaner 10 comprises a bottom part 12 which has a chassis 14 with two running wheels 20 and 22 which are arranged at a rear side 16 of the vacuum cleaner 10 and are rotatable about a common axis of rotation 18. At a front side 24 of the vacuum cleaner 10, the chassis 14 has two pivotable steering rollers, only one steering roller 26 of which is shown. The vacuum cleaner 10 may comprise a push bar, not shown in the drawings, at the rear side 16 for moving the vacuum cleaner on a floor surface 66.

The bottom part 12 forms a dirt collection container 28 in which sucked-in dirt can be separated. Vacuumed material can be sucked through a suction inlet 30 at the front side 24 into the dirt collection container 28. A suction hose 32, a section of which is shown in FIG. 3, is connectable in a manner known per se to the suction inlet 30. A suction nozzle is arranged at the end of the suction hose 32 that faces away from the vacuum cleaner 10.

The vacuum cleaner 10 further comprises a top part 34, a so-called "suction head", detachably mounted on the bottom part 12. The top part 34 and the bottom part 12 together form a housing 36 of the vacuum cleaner 10.

As shown, in particular, in the schematic representation in FIG. 3, the top part 34 comprises accommodating chambers 38 and 40 in which a suction unit 42 and an electronic control unit 44, respectively, are arranged. The suction unit 42 and the control unit 44 are arranged one above the other, in the area of a front half of the top part 34 that faces the front side 24.

The accommodating chamber 38 opens via a suction chamber 46 into the dirt collection container 28 so that the dirt collection container 28 can be acted on with negative pressure by the suction unit 42 via the suction chamber 46 and vacuumed material can be sucked in. A partition wall 48 between the dirt collection container 28, on the one hand, and the accommodating chamber 38 and the suction chamber 46, on the other hand, accommodates a filter element 50. The filter element 50, for example, a flat fold filter made of a paper material, serves to filter the air drawn in by the suction unit 42.

With increasing operation of the vacuum cleaner 10, particles accumulate on the filter element 50, with the result that the pressure rises in the dirt collection container 28 and vacuumed material can only be sucked into it with reduced power. The vacuum cleaner 10 has a filter cleaning device 52 for cleaning the filter element 50 and thereby achieving maintenance of as low a pressure as possible in the dirt collection container 28. The filter cleaning device 52 is arranged above the filter element 50 and mounted on a filter cover 54, which sealingly covers the filter element 50 in a covering position. This makes it possible to dispense with a separate sealing of the suction chamber 46 in the upward direction.

The filter cleaning device 52 is electronically controllable by the control unit 44. This, as well as the construction of the filter cleaning device 52, is known per se and will, therefore, not be explained in the present case. For example, the filter cleaning device 52, comprises a valve which can be opened at regular intervals by the control unit 44 so that the filter element 50 is acted on with pressure surges on the clean space side (i.e., from the side that faces away from the dirt collection container 28). The pressure surges form as a result of inflowing external air which can flow through an external air opening, not shown in the drawings, into the top part 34 so that when the closing valve is open, the filter element 50 is acted on with external air at atmospheric pressure on the clean space side.

A section of the filter cover 54 is of plate-shaped configuration, see, in particular, FIG. 2, and is mounted on the top part 34 so as to be pivotable about a pivot axis 56. For this purpose, the filter cover 54 has, at the front in the longitudinal direction of the vacuum cleaner 10, a bearing element 58, which interacts with a bearing element 60 of corresponding construction on a partition wall 62 of the top part 34 to form a hinge. The partition wall 62 starts from a top side 64 of the vacuum cleaner 10 and extends downwards as far as a plate-shaped section of the filter cover 54. The pivot axis 56 is horizontally aligned, in relation to a positioning of the vacuum cleaner 10 on a horizontal floor surface 66 (FIG. 3), and it extends in the transverse direction of the vacuum cleaner 10.

The filter cover 54 is transferable from a covering position shown in FIG. 2, in which, as mentioned above, it covers the filter element 50, to a removal position, not shown in the drawings, and arrestable therein. For this purpose, an arresting device 68 is provided, which, for example, is integrated into the hinge formed by the bearing elements 58 and 60. The arresting device 68 is constructed, in particular, as latching device and/or clamping device.

With the filter cover 54 in the removal position, the user has easy access from the rear side 16 to the filter element 50 so that the filter element 50 can be removed from and inserted into the vacuum cleaner 10 on the clean space side in a user-friendly manner. This requires a battery lid 70 of the top part 34, which will be referred to hereinbelow, to be in an open position (FIG. 2).

The battery lid 70 is formed as housing cover and hence part of the housing 36 and arranged in the area of the top side 64, the rear side 16 and the rearward sections of left and right sides of the vacuum cleaner 10. On the top side 64 the vacuum cleaner 10 has a ceiling wall 72 with a first wall section 74 and a second wall section 76, the first wall section 74 covering the accommodating chamber 40, and the second wall section 76 being comprised by the battery lid 70. The wall sections 74 and 76 form interacting bearing elements for formation of a hinge on the top side 64, which defines a pivot axis 78. The pivot axis 78 extends parallel to the pivot axis 56 and, therefore, horizontally and in the transverse direction of the vacuum cleaner 10.

The battery lid 70 further comprises side wall sections 80 and 82 on the left and the right, respectively, of the vacuum cleaner, and a rearward wall section 84 at the rear side 16.

The battery lid 70 is arranged above the filter cover 54 and covers it in a closed position. In the closed position of the battery lid 70, the housing 36 is closed, and the wall sections 74 and 80 to 84 are in alignment with the remaining wall sections of the housing 36 at its top side 64, rear side 16 and left and right sides.

The battery lid 70 can be transferred to the above-mentioned open position by being pivoted about the pivot axis 78 from the rear side 16 forwards. For arresting the battery lid 70 in the open position, the vacuum cleaner 10 has an arresting device 86 which, for example, is formed by the wall sections 74 and 76 forming the hinge. In the present case, the arresting device 86 is configured, in particular, as latching device and/or as clamping device.

The vacuum cleaner 10 is a so-called hybrid vacuum cleaner to which electrical energy can be supplied, on the one hand, via a connecting cable 88 arranged at the rear side 16 (only shown in FIG. 1). On the other hand, electrical energy can be supplied to the vacuum cleaner 10 via two rechargeable batteries, for example, lithium-ion accumulators 90. Both batteries 90 are accommodated in battery receptacles 92 which are comprised by the battery lid 70 and are arranged, in particular, integrated in the battery lid 70.

The battery receptacles 92 are each of shaft-shaped configuration and horizontally aligned and comprise an opening 94 arranged at the rear side 16. The respective battery 90 can be inserted into and removed from the respective battery receptacle 92 via the opening 94. The horizontal alignment of the battery receptacles 92 makes a constructionally simple configuration possible, in which the batteries 90 can be supported downwards on bottoms of the battery receptacles 92. Furthermore, it is difficult for dirt to accumulate in the battery receptacles 92, unlike in battery receptacles, for example, which extend upwards and have openings located at the top.

A user is able to exchange the batteries 90 in a user-friendly manner by the batteries 90 being pulled out of and pushed into the battery receptacles 92 horizontally. FIG. 1 shows how one of the batteries 90 (the right-hand battery 90 in the drawing) is partially pushed into the battery receptacle 92 allocated to it.

In the designated position, a section of the batteries 90 protrudes from the battery receptacles 92 (see the left-hand battery 90 in FIG. 1 and the batteries 90 in FIG. 2). This makes it easier for a user to grip the batteries 90 in order to remove them from the battery receptacles 92.

When the battery lid 70 is pivoted, the batteries 90 are also pivoted about the pivot axis 78. This offers the possibility of raising the battery lid 70 by pivoting it so that it is even easier for a user to reach the batteries 90 (FIG. 2).

It is conceivable for the batteries 90 to be charged in the battery receptacles 92 when the vacuum cleaner is operated by energy supplied via the connecting cable 88.

In the vacuum cleaner 10 in accordance with the invention, the arrangement of the battery lid 70 with integrated battery receptacles 92 above the filter cover 54 makes it possible to achieve a compact design. In particular, it is possible to arrange the control unit 40 alongside the battery lid 70 and the suction unit 42 alongside the filter cover 54 and the filter element 50. As a result, the vacuum cleaner 10 has a slim structure, and only a small amount of space is taken up on the floor surface 66.

The arrangement of the battery receptacles 92 in the battery lid 70 also makes it possible to dispense with battery receptacles on the filter cover 54, as is, for example, the case in the vacuum cleaner described in the publication WO 2012/062579 A1 mentioned at the outset. This allows the constructional height of the filter cover 54 to be reduced and a compact design to therefore be imparted to the vacuum cleaner 10 in its entirety.

When the battery lid 70 is transferred to the open position, access to the filter cover 54 on the clean space side is also made easier for the user. Unlike in the vacuum cleaner described in the above-mentioned publication, it is not necessary to previously remove the batteries 90 from the battery receptacles 92. Instead these may remain in the battery lid 70.

Figure 4:
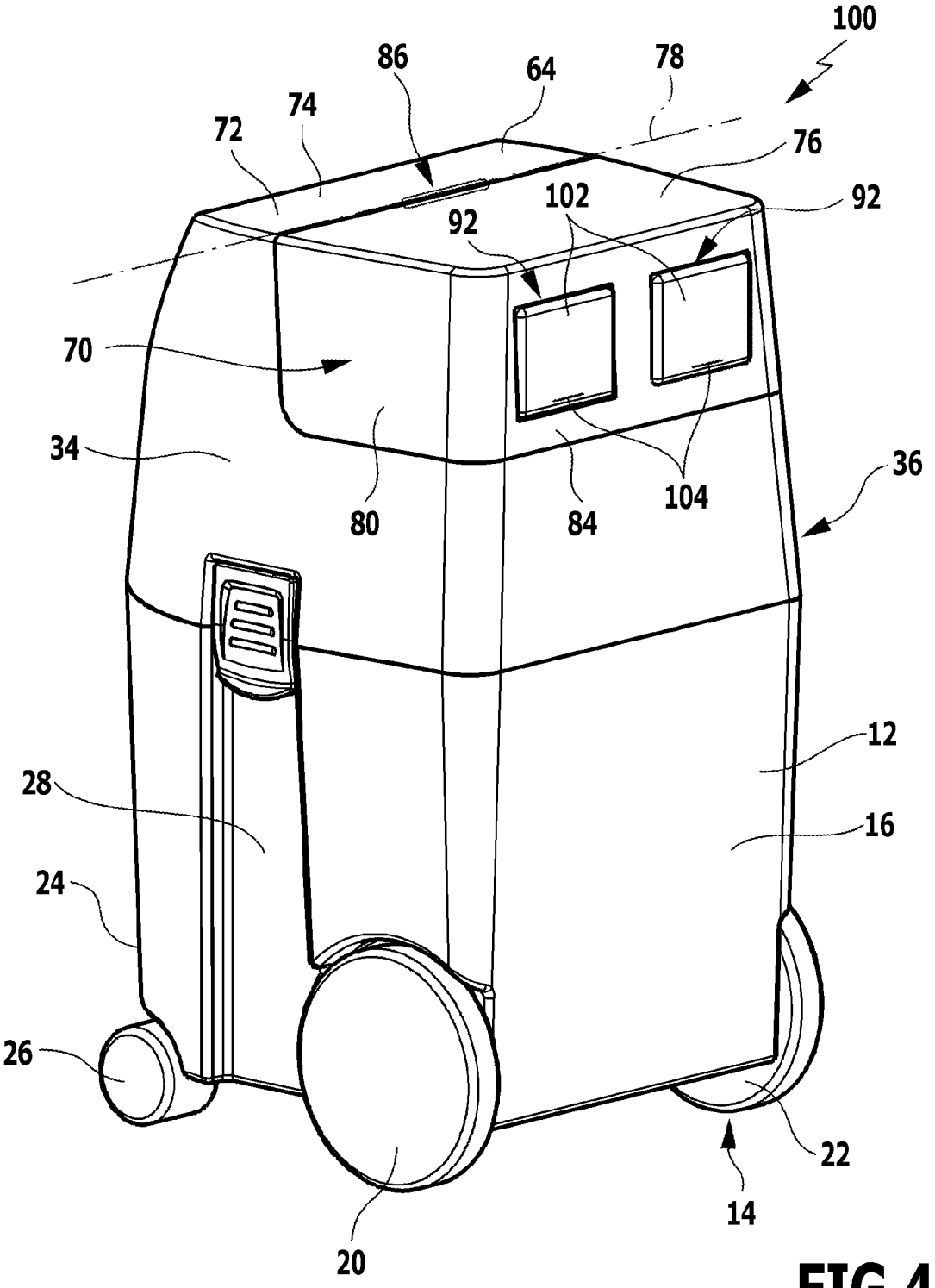
FIG. 4 shows a perspective representation of a second preferred embodiment of a vacuum cleaner in accordance with the invention.

FIG. 4 shows in a manner corresponding to FIG. 1 a second preferred embodiment of a vacuum cleaner denoted in its entirety by reference numeral 100. The vacuum cleaner 100 is substantially identical in configuration to the vacuum cleaner 10, and the advantages achievable with it can also be achieved with the vacuum cleaner 100. Identical reference numerals are, therefore, used for features and components of the vacuum cleaners 10 and 100, which are the same and have the same effect, and only the essential differences between the two vacuum cleaners 10 and 100 will be referred to hereinbelow.

In the vacuum cleaner 100, the battery receptacles 92 have protective covers 102 for closing the openings 94 at the rear side 16. The protective covers 102 are provided to protect the battery receptacles 92 against dirt and liquid, for example, spray water, entering. For this purpose, the protective covers can adopt protective positions in which the openings 94 are sealingly closed. By means of an actuating element 104, for example, in the form of a handle, the protective covers 102 can be transferred to a release position in which the batteries 90 can be inserted into or removed from the battery receptacles 92.

It is also conceivable for the protective covers to only adopt a protective position when no batteries 90 are arranged in the battery receptacles 92. Otherwise the protective covers 102 may adopt the release position, and, in this case, too, a section of the batteries 90 may protrude from the battery receptacles 92.

The protective covers 102 can be held, for example, in a clamping and/or latching manner on the rest of the battery receptacle 92. Furthermore, it is possible for the protective covers 102 to be movably mounted, in particular, pivotably or displaceably mounted.

The invention claimed is:

1. A vacuum cleaner, comprising a dirt collection container for sucked-in vacuumed material, a suction unit for acting on the dirt collection container with negative pressure via a suction chamber, at least one filter element arranged between the dirt collection container and the suction chamber in the flow direction of the air sucked in by the suction unit, and a filter cover covering the filter element on the clean space side, at least one rechargeable battery for providing electrical energy for the suction unit, and at least one battery receptacle for holding the at least one battery on the vacuum cleaner, wherein the vacuum cleaner comprises a battery lid, which includes the at least one battery receptacle, and which, in relation to a positioning of the vacuum cleaner on a floor surface in an operating position, is arranged above the filter cover, the battery lid being transferable from a closed position in which it covers the filter cover to an open position in which a user has access on the clean space side to the filter cover, and vice versa.

2. The vacuum cleaner in accordance with claim 1, wherein the battery lid and the filter cover are arranged alongside at least one accommodating chamber in which at least one of the suction unit and an electronic control unit of the vacuum cleaner are arranged.

3. The vacuum cleaner in accordance with claim 1, wherein the at least one battery is removable from the at least one battery receptacle when the battery lid is in the closed position.

4. The vacuum cleaner in accordance with claim 1, wherein the at least one battery receptacle comprises an opening arranged at a rear side of the vacuum cleaner, in relation to a longitudinal direction thereof, for passing the at least one battery therethrough.

5. The vacuum cleaner in accordance with claim 1, wherein the at least one battery receptacle forms an accommodating shaft for the at least one battery.

6. The vacuum cleaner in accordance with claim 5, wherein the accommodating shaft is aligned horizontally.

7. The vacuum cleaner in accordance with claim 1, wherein in a designated position in the at least one battery receptacle, a section of the at least one battery protrudes therefrom.

8. The vacuum cleaner in accordance with claim 1, wherein the at least one battery receptacle comprises a protective cover which, in a protective position, sealingly closes the at least one battery receptacle, and is transferable to a release position, and vice versa, in which release position the at least one battery is removable from or insertable into the at least one battery receptacle.

9. The vacuum cleaner in accordance with claim 1, wherein the battery lid forms a housing cover of a housing of the vacuum cleaner.

10. The vacuum cleaner in accordance with claim 1, wherein the battery lid is pivotably mounted on the vacuum cleaner for transfer from the closed position to the open position and vice versa.

11. The vacuum cleaner in accordance with claim 1, wherein the vacuum cleaner comprises an arresting device for arresting the battery lid in the open position.

12. The vacuum cleaner in accordance with claim 1, wherein the filter cover is transferable from a covering position in which the at least one filter element is covered to a removal position in which the at least one filter element is removable from and insertable into the vacuum cleaner on the clean space side, and vice versa.

13. The vacuum cleaner in accordance with claim 12, wherein the filter cover is pivotably mounted on the vacuum cleaner for transfer from the covering position to the removal position and vice versa.

14. The vacuum cleaner in accordance with claim 12, wherein the vacuum cleaner comprises an arresting device for arresting the filter cover in the removal position.

15. The vacuum cleaner in accordance with claim 1, wherein the vacuum cleaner comprises a filter cleaning device for cleaning the at least one filter element.

16. The vacuum cleaner in accordance with claim 15, wherein the filter cleaning device is mounted on the filter cover.

17. The vacuum cleaner in accordance with claim 1, wherein the filter cover in the covering position or a filter cleaning device mounted on the filter cover in the covering position of the filter cover sealingly closes the suction chamber.

18. The vacuum cleaner in accordance with claim 1, wherein the vacuum cleaner is a bagless vacuum cleaner.

19. The vacuum cleaner in accordance with claim 1, wherein the vacuum cleaner is a hybrid vacuum cleaner having a connecting cable which is connectable to an energy supply network for providing electrical energy to the vacuum cleaner.

* * * * *